US007637027B1

(12) United States Patent
Grotto

(10) Patent No.: US 7,637,027 B1
(45) Date of Patent: Dec. 29, 2009

(54) CEILING UTILITY ALIGNMENT TEMPLATE

(76) Inventor: Peter Grotto, 1019 Gambelli Dr., Yorktown Heights, NY (US) 10598

( * ) Notice: Subject to any disclaimer, the term of this patent is extended or adjusted under 35 U.S.C. 154(b) by 24 days.

(21) Appl. No.: 11/999,125

(22) Filed: Dec. 4, 2007

(51) Int. Cl.
*G01B 5/25* (2006.01)

(52) U.S. Cl. ..... 33/562; 33/645

(58) Field of Classification Search ..... 33/562, 33/563, 613, 645
See application file for complete search history.

(56) References Cited

U.S. PATENT DOCUMENTS

| | | | | | |
|---|---|---|---|---|---|
| 2,770,886 | A * | 11/1956 | Johnson | 33/645 |
| 3,824,666 | A * | 7/1974 | Roodvoets et al. | 33/286 |
| 4,084,325 | A * | 4/1978 | Jones, Jr. | 33/670 |
| 4,326,283 | A * | 4/1982 | Toulan et al. | 33/645 |
| 4,945,642 | A * | 8/1990 | Saulietis | 33/562 |
| 5,068,976 | A * | 12/1991 | Bell | 33/613 |
| 5,910,202 | A | 6/1999 | DeMarc | |
| 5,979,068 | A | 11/1999 | Andrews | |
| 6,117,514 | A | 9/2000 | Hermann | |
| 6,158,519 | A | 12/2000 | Kretschmer | |
| 6,247,238 | B1 * | 6/2001 | Harvey et al. | 33/286 |
| 7,269,908 | B1 * | 9/2007 | Alvar | 33/529 |
| 2008/0216335 | A1 * | 9/2008 | Crorey | 33/528 |

* cited by examiner

*Primary Examiner*—G. Bradley Bennett
(74) *Attorney, Agent, or Firm*—Furgang & Adwar, L.L.P.

(57) ABSTRACT

A ceiling utility alignment template includes a base and a boss extending from one side of the base. The base has dimensions substantially similar to the dimensions of a ceiling tile placed within an opening in a grid formed by a frame. The boss extends from a first side of the base at a predetermined position thereof. The boss is used to align a ceiling utility above a tile ceiling.

19 Claims, 5 Drawing Sheets

FIG.6a
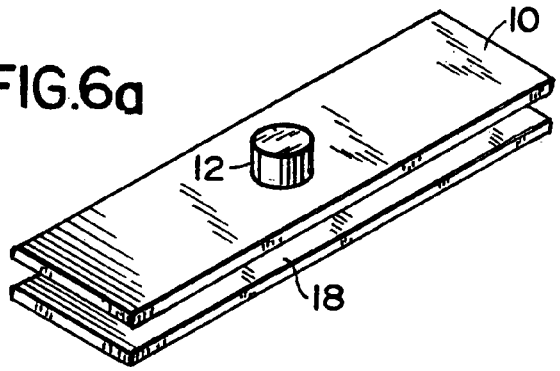
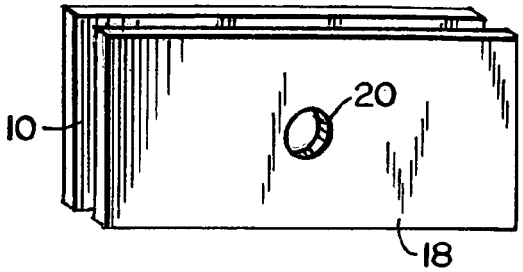
FIG.6b
FIG.7
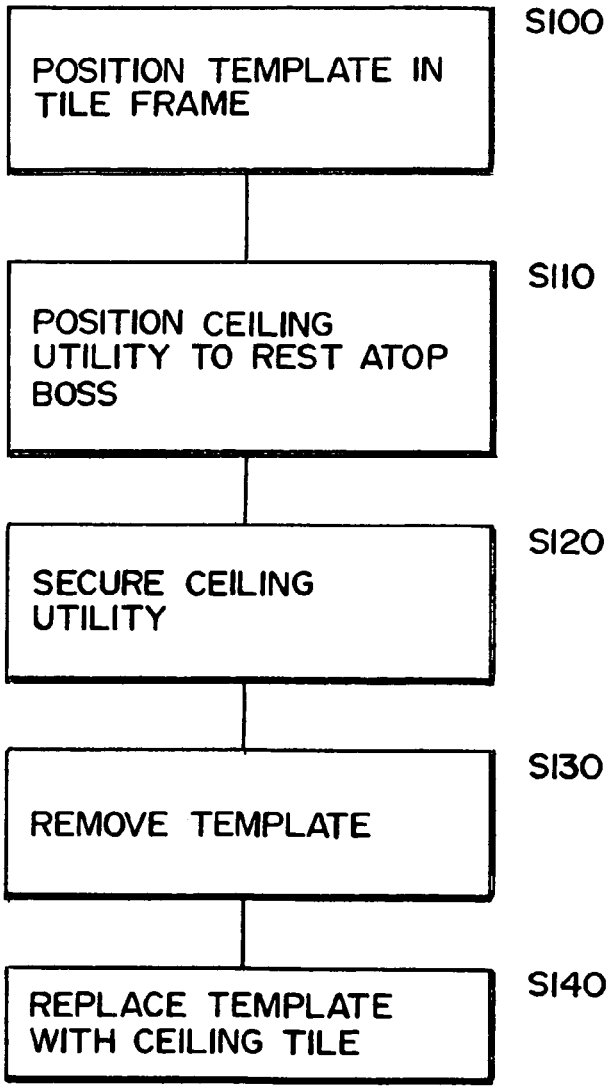

CEILING UTILITY ALIGNMENT TEMPLATE

BACKGROUND OF THE INVENTION

1. Field of the Invention

The present device relates to measurement devices and, more specifically, to a template for aligning a ceiling utility.

2. Description of the Prior Art

Ceiling utilities requiring direct access to a room extend below a ceiling frame and through the center of a tile to add to the aesthetic appearance of the room. In order to extend through the center of a ceiling tile, the position of the utility extension needs to be aligned with the center of a grid opening in the ceiling frame. Once the utility is aligned with the center of the grid opening, a ceiling tile with a hole cut out at its center can be placed within the grid opening so that the utility extension extends through its center.

A variety of devices to calculate the center of a tile opening are exemplified in the following United States patents.

U.S. Pat. No. 5,979,068 issued to Andrews on Nov. 9, 1999, describes a gauge to be installed before the completion of the overhead system and before the ceiling tiles are installed. Once the gauge is installed, the arms can be extended to find the center of the tile. An extendable arm can then extend upwards to help define the center of the tile and where to position the fire sprinkler head.

U.S. Pat. No. 6,249,238 issued to Harvey et al. on Jun. 19, 2001, describes a laser marking device for marking a reference point with laser light so that accurate measurements can be made to that point. The laser marking device has a support bar whose ends are adapted to slidably rest on an adjacent pair of bars of the grid. Thus, once the user positions the device at the center of the tile, a laser can shine a light towards the ceiling indicating the axis along which to drop the sprinkler head through the tile grid.

U.S. Pat. No. 6,158,519 issued to Kretschmer on Dec. 12, 2000, describes a sprinkler head support bracket which is installable immediately above a ceiling tile. The assembly is the size of a plurality of tiles, roughly fifteen, and is secured in place above the grid by nylon straps. The bracket contains a flexible arm mover connected to a pipe clamp that is secured above a tile opening in the support bracket. A pipe is then routed through one of the openings in the pipe clamp which represents the center of the tile.

U.S. Pat. No. 6,117,514 issued to DeMarc on Jun. 8, 1999, describes a ceiling tile system with interlocking plastic ceiling tiles for covering a ceiling. Each tile has a side ridge on each side and corner tabs at each corner. The tabs and ridges are configured such that the ridges fit within the ridges of an adjacent panel and the corner tabs of the second panel are placed over the corner tabs of the first. Each tile is decorative with a star-shaped design forming a relief on one face of the tile and a raised shape on the other face. The shape is generally in the shape of a star with a circular portion at its center. Within the raised circular center, there is a circular depression at its center creating another detail to add to the tile's aesthetic quality. From the center portion, arms extend to make the shape of a star.

The patents discussed above describe complex positioning devices to find the center of a grid opening within a frame or disclose decorative tiles with designs in the center. However, these devices and systems for finding the center of a grid opening within a frame are difficult to work with and time consuming.

In addition, the patents discussed above describe methods for finding the center of a tile opening that are costly and expensive to implement. Specifically, the methods require substantial hardware and measuring devices.

SUMMARY OF THE PRESENT INVENTION

It is an object to provide a template fitted within a ceiling tile frame and having a boss attached thereto for the alignment of a ceiling utility is described herein.

It is an object to provide an alignment template for quickly and easily positioning an extension of a ceiling utility through a grid opening. Specifically, a boss may be located at a desired predetermined position of a first face of a template having dimensions that allow it to fit within a grid opening in the ceiling frame. When the template is placed within the frame formed by a grid, the boss extends in the direction towards the ceiling utility. Thus, when positioning an extension of a utility to extend through a predetermined position within the grid, one can position the extension of the utility to extend to the boss of the template identifying the predetermined position of the grid opening.

It is a further object to provide a system for aligning a utility with a predetermined position within a grid opening that is inexpensive and disposable. Specifically, the template may be constructed as a simple plastic blow mold or cast disposable device. A boss may be glued or affixed to the template at a desired position.

It is another object to provide a ceiling utility alignment template having a base and a boss extending from a first side of the base. The base has dimensions substantially similar to dimensions of a grid opening within a ceiling frame. The boss may be used to align a ceiling utility located above the ceiling frame.

It is a further object to provide a method of positioning a ceiling utility. The method includes positioning a template within a grid opening of a ceiling frame, with a boss of the template extending above the ceiling frame. A ceiling utility is positioned to rest atop the boss. The ceiling utility is then secured in its position resting atop the boss. The template is removed. A ceiling tile is positioned within the grid opening such that the utility extends above a predetermined position of a ceiling tile placed within the grid opening.

It is a yet further object to provide a system of finding a predetermined position of a tile opening that is both inexpensive and disposable.

BRIEF DESCRIPTION OF THE DRAWING FIGURES

In order that the device may be more fully understood, it will now be described, by way of example, with reference to the accompanying drawings in which.

Figure 3A:
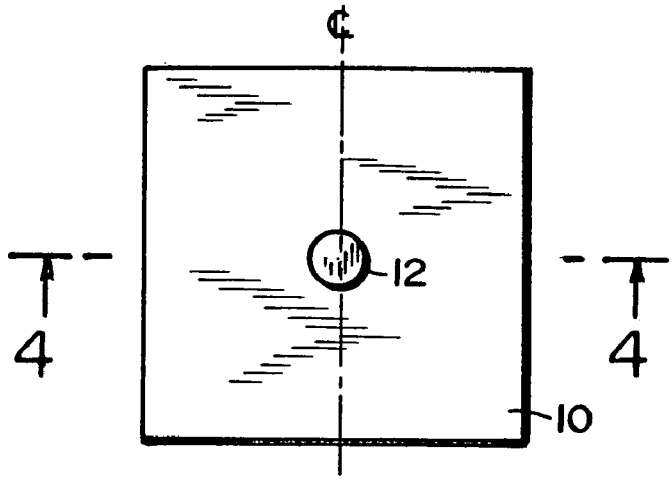
Figure 3B:
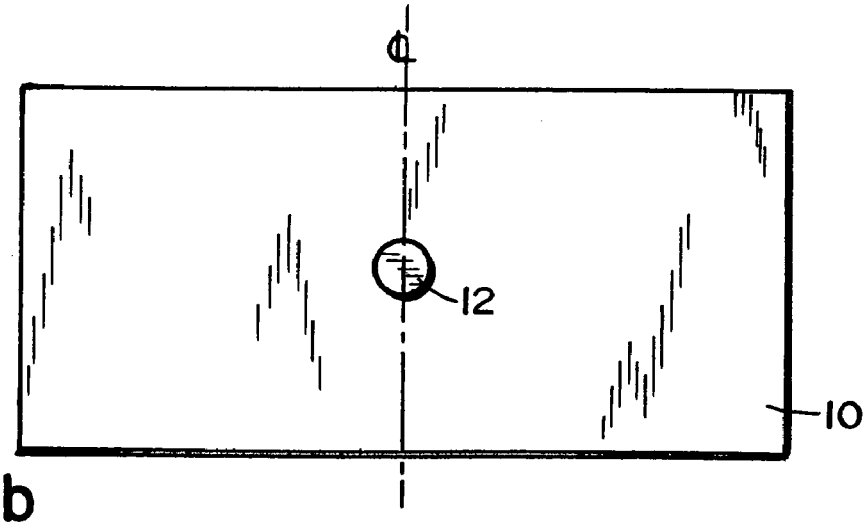
Figure 4A:
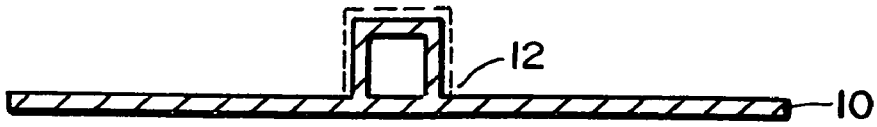
Figure 4B:
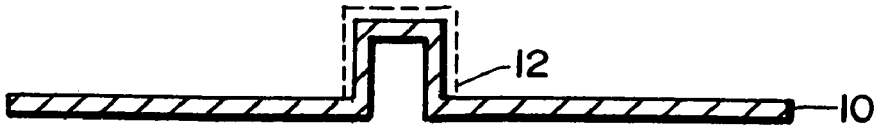
Figure 5:
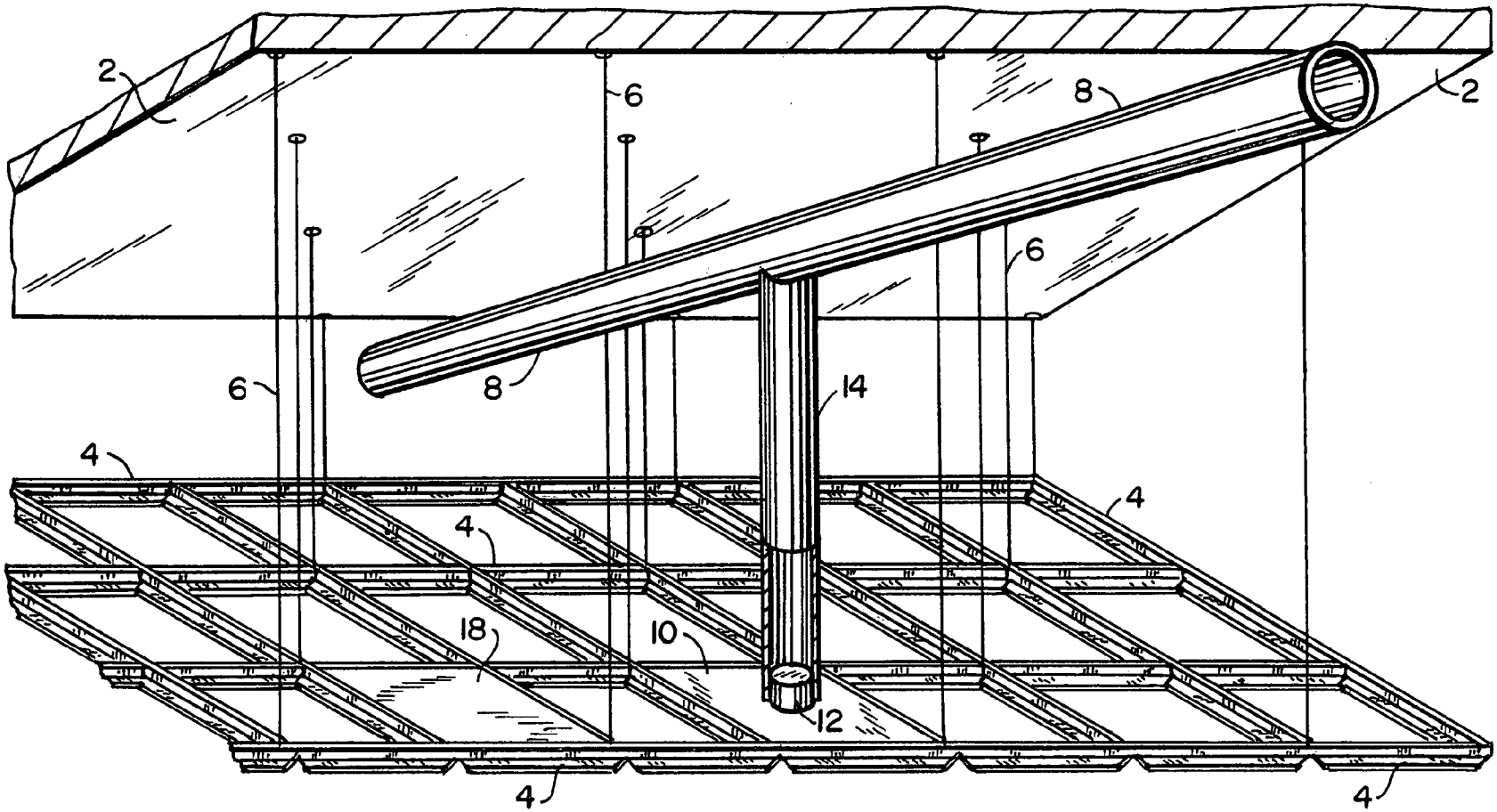

FIGS. 3*a* and 3*b* are aerial views of ceiling utility alignment templates of different dimensions;

FIGS. 4*a* and 4*b* are side cross-sectional views of the ceiling utility alignment template with a boss connected thereto or molded therein;

FIG. 5 is a perspective view of the ceiling utility alignment template in use within a ceiling frame;

FIG. 6*a* is a perspective view of the ceiling utility alignment template placed over a ceiling tile for cutting a hole in the center of the tile;

FIG. 6*b* is a perspective view of the ceiling tile with a hole cut in its center matching the location of the stub of the template; and FIG. 7 is a flow diagram illustrating a method for aligning a ceiling utility using the ceiling utility alignment template.

DETAILED DESCRIPTION OF THE PREFERRED EMBODIMENT

The following discussion describes the device. This discussion should not be construed, however, as limiting the device to that particular embodiment. Practitioners skilled in the art will recognize numerous other embodiments as well.

Currently there are many ways to build a ceiling. One can have exposed beams, sheetrock, concrete or ceiling tiles. In commercial and many residential facilities, ceiling tiles in a suspended ceiling are most popular. The ceiling tiles are positioned within a frame, defined by a matrix of intersecting metal supports that form a grid, which is suspended from the ceiling. One well-known benefit of ceiling tiles is that they provide better insulation from heat and/or noise. Another benefit is that by using relatively inexpensive lightweight tiles, portions of the ceiling can be easily replaced upon the occurrence of damage to the ceiling tiles. Yet another benefit is that many utilities are accessible in the ceiling above the tiles. Thus, both water and electrical utilities may be accessed and positioned through ceiling tiles with relative ease.

Figure 1:
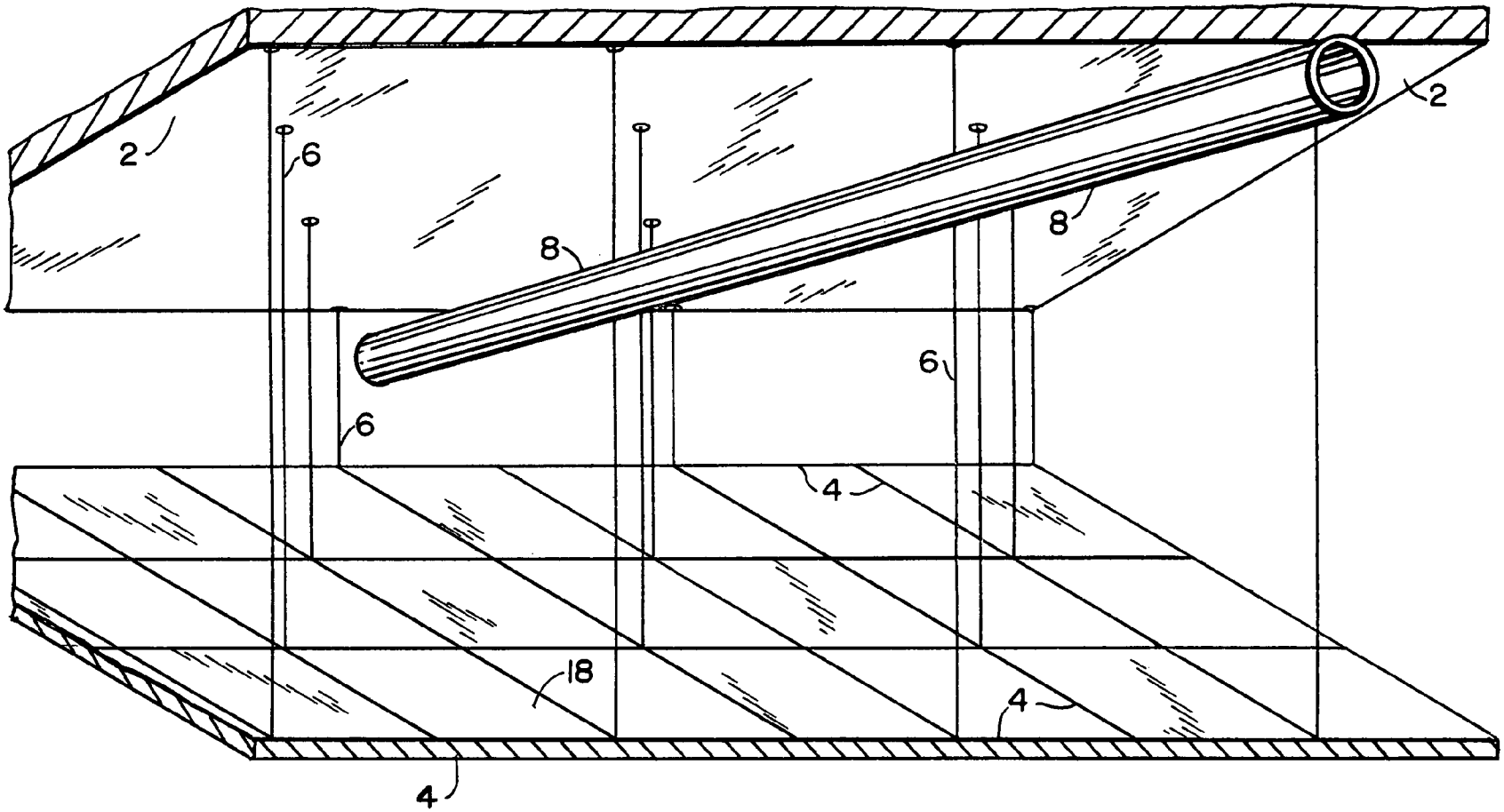
FIG. 1 is a perspective view of a ceiling frame.

FIG. 1 is a perspective view of a frame forming a grid for receiving ceiling tiles. The frame 4 is suspended from the ceiling 2 using wires 6. The frame 4 is defined by intersecting metal supports forming a grid. Ceiling tiles 18 are placed within openings (herein referred to as "grid opening") of the frame 4 to provide insulation. Ceiling tiles 18 are generally of the same dimensions as the tile openings in the frame so that they can easily fit within and reside therein. Ceiling tiles 18 are generally lightweight, and can be tailored for a variety of uses. For instance, tiles may provide thermal insulation, sound absorption and fire protection. Utilities, such as a water utility pipe 8, run between the ceiling and the frame 4.

Figure 2:
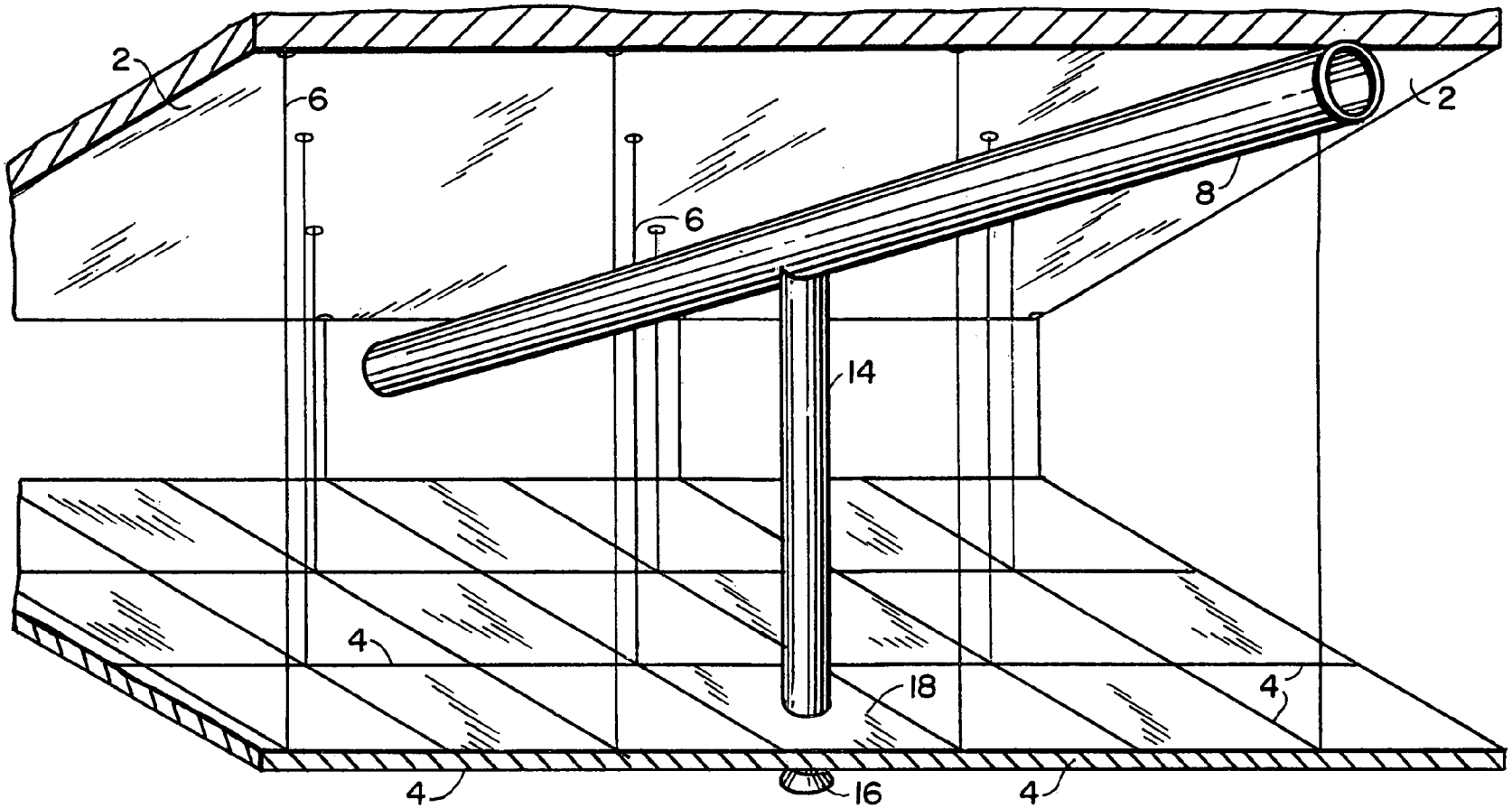
FIG. 2 is a perspective view of a utility extending through a tile of a ceiling frame.

As illustrated in FIG. 2, sometimes it is desirable for utilities to have direct access to the room below. For instance, a fire sprinkler system requires that the water utility has direct access to the room to extinguish fires therein. Thus, an extension 14 is connected to the water utility pipe 8 that runs between the ceiling 2 and the frame 4. A sprinkler head 16 is attached to the extension 14 and extends down into the room through a hole cut into a ceiling tile 18 resting within the frame 4.

FIGS. 3*a* and 3*b* are aerial views of ceiling utility alignment templates of different dimensions. Suspended ceiling frames may have openings of any geometric shape defined by the ceiling frame matrix. The template 10 has dimensions able to be received within a frame opening of the matrix. For illustrative purposes, FIGS. 3*a* and 3*b* describe template 10 for use in ceiling frames with grid openings of popular shapes—rectangles. However, templates may be formed of any shape able to be received by a grid opening of a frame in which it may be placed.

A boss 12 may protrude from one side of the template 10 at a predetermined position of the first side. The boss 12 may be formed integrally with the first side as by molding (as will be described in FIG. 4*b*) or simply glued or attached onto the first face of the template 10 (as will be described in FIG. 4*a*) in any manner that will secure the boss to the template. In one embodiment, the boss 12 is positioned at a center of the template 10. This positioning may be used to provide an aesthetically pleasing appearance of utility extensions protruding into the room. However, it should be noted that the boss 12 may be positioned in any predetermined location on the template 10, corresponding to a desired position in which an extension of the utility is to extend and/or enter the room. Thus, for example, in a rectangular template have equal dimensions (i.e., a square) template 10 (FIG. 3*a*) the centered boss 12 may be located equidistant from each edge of the template 10. In another example in rectangular template 10 (FIG. 3*b*) the centered boss 12 may be located equidistant from opposing edges of the template 10.

FIGS. 4*a* and 4*b* show side cross-sectional views of ceiling utility alignment templates with a boss which may be connected thereto or molded thereon. A cross-section is taken along the dashed line 4-4 of FIG. 3*a*. The template 10 may have any desired thickness. For example, the opposed faces of the template may be planar and have similar dimensions as a ceiling tile for more accurately fitting within framed opening of the frame. As illustrated in FIG. 4*a*, the boss 12 may extend from the template 10. In this way, the template 10 may be easily constructed/manufactured as a simple flat shape (FIG. 1) and the boss 12 may be formed integrally with the template or connected thereto after production of the template. The boss 12 may be made of any material such as, as for example, the material from which the supported base is made, such as molded integrally from plastic or connected to the first face of the template 10 using glue, screws or any other method of fixation. (FIG. 4*b*)

The template may be provided with a recess 11 in the template 10 or a predetermined position thereof in registry with the boss 12. Thus, the boss 12 may molded over the recess 11. A diameter of the recess 11 may be substantially the same as a diameter of both the boss 12 and a pipe extending from the utility which may desired to extend through a ceiling tile positioned within a predetermined location in the grid opening (FIG. 5). Additionally, the boss 12 may be raised from the template 10 and so dimensioned as to support a pipe placed over it (FIG. 5).

FIG. 5 is a perspective view of the ceiling utility alignment template 10. In use the frame 4 may be first suspended from the ceiling 2 using wires 6 or other means as is well known in the art. A utility pipe 8 may have first been run between the ceiling 2 and the frame 4. The frame 4 may contain multiple grid openings for receiving and supporting ceiling tiles 18, as is well known. The ceiling utility alignment template 10 boss 12 may be located at a center or other predetermined position of the first face thereof, and positioned within a grid opening in the matrix 4 in place of or before the installation of a tile 18.

An extension 14, which may be intended to engage the utility, such as the utility pipe 8 may then be positioned to extend from the template 10 from the boss. The extension 14 may have an opening that fits directly over the boss 12 and the boss 12 is of a substantial height to support the extension 14 a predetermined distance above the frame. Alternatively, the extension 14 of a utility pipe 8 may extend to touch or rest upon the boss 12 instead of being placed over the boss 12. Thus, in this example, a user may simply position an extension 14 of a utility 8.

It should also be appreciated that the template 10 provides a method of aligning the utility extension 14. It is believed that the template 10 allows an installer to save a significant amount of time in positioning a utility extension 14, as compared with the devices and methods employed by the prior art.

FIG. 6*a* is a perspective view of the ceiling utility alignment template placed over a ceiling tile for use in cutting a hole in the center of the tile. The boss 12 may be aligned with a desired position of ceiling tile for aiding in cutting a hole in the center or other desired position of a ceiling tile 18. Specifically, a user can place a ceiling tile 18 over the first face of the ceiling utility alignment template 10 (having the boss 12). Pressure ay then be applied to the ceiling tile 18, forcing the ceiling tile 18 and the ceiling utility alignment template 10 closer together. However, the ceiling tile 18 and the ceiling utility alignment template 10 will remain separated by the height of the boss 12. The ceiling tile 18 may exert a small amount of flexibility at all locations except at the position of the boss 12. The force applied by the boss 12 indicates to the position at which to cut an aperture through the tile. An aperture can then be cut that has substantially the same diameter or shape of the boss 12 and is positioned within so as to be aligned with the position of the utility where it engages the ceiling tile in its predetermined location.

In one approach, the boss 12 may have marking material around its edges. In this way, when a pressure is applied to the ceiling tile 18 in a direction towards the boss 12 in a cookie-cutter fashion, an outline of the boss 12 will be marked on the ceiling tile 18 indicating the dimensions and location needed to cut a hole in a position of the ceiling tile corresponding to the aligned ceiling utility extension 14. In another embodiment, the boss 12 may have raised edges such that, when a pressure is exerted on a ceiling tile 18 towards the aligned template and the boss 12, an outline of the boss 12 will be created by the pressure exerted. The outline of the boss 12 indicates the dimensions and location for cutting a hole in a ceiling tile corresponding to the ceiling utility extension 14 positioned using the template.

In yet another embodiment, instead of a user cutting a hole in the ceiling tile 18 based on the flexibility caused by the boss 12, a user can cut a hole in the ceiling tile 18 based on the flexibility in a portion of the ceiling tile that is positioned over the recess 11 of template 10. As illustrated in FIG. 4*b*, a recess 11 may be molded into the template 10 with a boss 12 molded over, such that the boss 12 protrudes from a first face of the template 10 and the recess 11 is accessible from a second face of the template 10. A ceiling tile 18 may be placed over the second face of the template 10 having the recess 11. Pressure is then applied to the ceiling tile 18, forcing the ceiling tile 18 and the ceiling utility alignment template 10 together. The pressure applied to the ceiling tile 18 may cause it to flex or bend at the recess 11 due to the lack of opposing force by the recess 11. Based on the impression made in the tile, a hole may then be cut with substantially the same diameter as the recess 11, which, in turn, may have substantially the same diameter at the boss 12.

FIG. 6*b* is a perspective view of the ceiling tile with a hole cut in its center matching the location of the boss of the template. By utilizing markings created by the boss 12, pressure exerted by the raised boss 12 or pressure exerted towards the recess 11, a user may produce a hole that is in the ceiling tile and aligned with the extension of the utility pipes or electrical utilities.

FIG. 7 is a flow diagram illustrating a method for aligning a ceiling utility using a template. A user begins by positioning the ceiling utility alignment template in a grid opening of the frame in step S100. A ceiling utility, located above the frame and below the ceiling, is then positioned to rest atop a boss of the ceiling utility alignment template in step S110. The boss may be located at any predetermined location of the ceiling utility alignment template. The ceiling utility may then secured or positioned atop the boss of the ceiling utility alignment template in step S120. Once secured, a user may install the utility so that it is position with respect to the ceiling utility alignment template. The ceiling utility alignment template may then be removed in step S130. With the ceiling utility aligned with the predetermine position within the framed opening, a ceiling tile may then be placed in the framed opening where the ceiling utility alignment template once was—replacing the ceiling utility alignment template in step S140.

While certain novel features of this device and method have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the device and method for using the device.

Without further analysis, the foregoing will so fully reveal the gist that others can, by applying current knowledge, readily adapt it for various applications without omitting features that, from the standpoint of prior art, fairly constitute essential characteristics of the generic aspects of this device and method for using the device.

What is claimed is:

1. A ceiling utility alignment template comprising:

a base having predetermined dimensions so as to be disposed within and supported by at least a part of a frame formed by a matrix of a suspended ceiling; and a boss extending from a first side of said base at a predetermined location of said base, said boss being used to align a utility with said predetermined location of said boss.

2. The ceiling utility alignment template of claim 1, wherein said base in the marginal edges define a predetermined regular geometric shape.

3. The ceiling utility alignment template of claim 1, wherein a cross-section of said boss is in the shape of a regular geometric shape.

4. The ceiling utility alignment template of claim 1, wherein said boss is hollow.

5. The ceiling utility alignment template of claim 4, wherein said base has a second side opposed to said first side and a recess extending therethrough a side opposed to said first side.

6. The ceiling utility alignment template of claim 5, wherein said boss is positioned in alignment with said recess.

7. The ceiling utility alignment template of claim 6, wherein a ceiling tile can be disposed over said recess such that a hole may be cut in said ceiling tile at the position of said recess.

8. The ceiling utility alignment template of claim 1, wherein a ceiling tile can be placed over said boss for cutting a hole in said ceiling tile at the position of said boss.

9. The ceiling utility alignment template of claim 1, wherein the ceiling utility is a water system.

10. The ceiling utility alignment template of claim 9, wherein the water system is a fire sprinkler system.

11. The ceiling utilizing alignment template of claim 1, wherein said boss has marking edge for creating mark on a ceiling tile at a predetermined location.

12. A method of positioning a ceiling utility comprising the activities of:

positioning a template within a framed opening defined by a matrix of a suspended ceiling;

providing the template with a boss extending into an area above the matrix and beneath the ceiling;

locating a ceiling utility to rest atop the boss; and positioning a ceiling tile within the frame opening.

13. The method of claim 12, further comprising the activity of positioning the boss at a predetermined location on a first side of the template.

14. The method of claim 12, further comprising the activity of providing the boss with a conduit-like shape for receiving a utility.

15. The method of claim 12, further comprising the activity of providing the template with a recess extending from a second side to the opposed first side.

16. The method of claim 12, further comprising the activity of placing the ceiling tile over the recess in the template; and cutting a hole in the ceiling tile at the position of the recess.

17. The method of claim 12, further comprising the activity of placing the ceiling tile over the boss; and cutting a hole in the ceiling tile at the position of the boss.

18. The method of claim 12, further comprising the activity of providing a water system as the utility.

19. The method of claim 18, further comprising the activity of providing the water system as a fire sprinkler system.

* * * * *